US006931694B2

(12) United States Patent
Chen

(10) Patent No.: US 6,931,694 B2
(45) Date of Patent: Aug. 23, 2005

(54) HANGING RING USED IN CURTAIN

(76) Inventor: Zhi Ting Chen, 235 Chung-Ho, Box 8-24, Taipei (TW)

( * ) Notice: Subject to any disclaimer, the term of this patent is extended or adjusted under 35 U.S.C. 154(b) by 17 days.

(21) Appl. No.: 10/662,434

(22) Filed: Sep. 16, 2003

(65) Prior Publication Data

US 2005/0055799 A1 Mar. 17, 2005

(51) Int. Cl.[7] ..... E05D 15/00
(52) U.S. Cl. ..... 16/87.2
(58) Field of Search ..... 4/608, 610, 558; 24/103, 104, 113 A, 113 R, 115 G, 115 K, 116 A, 713.6; 16/87.2, 87.6 R, 87.6 W, 87.6; 160/330, 340, 341, 344, DIG. 6, 349.1, 349.2, 348, 388; 248/261, 262, 266, 301, 304, 339, 215; D6/323, 324, 320, 566, 567, 547; D8/367, 371, 368–372, 352

(56) References Cited

U.S. PATENT DOCUMENTS

| | | | | | |
|---|---|---|---|---|---|
| 279,236 | A | * | 6/1883 | Fletcher | 24/364 |
| 740,090 | A | * | 9/1903 | Cohen | 16/87.2 |
| 759,045 | A | * | 5/1904 | Tracy | 16/87.2 |
| 1,811,619 | A | * | 6/1931 | Dwyer | 160/348 |
| 2,711,555 | A | * | 6/1955 | Hanson | 16/87.2 |
| 3,596,306 | A | * | 8/1971 | Wachenheimer | 16/87.2 |
| 4,423,565 | A | * | 1/1984 | Bart | 446/16 |
| 4,675,939 | A | * | 6/1987 | Fukada | 16/87.2 |
| D335,816 | S | * | 5/1993 | Fraker et al. | D8/369 |
| 5,345,992 | A | * | 9/1994 | Turner | 160/330 |
| 5,428,867 | A | * | 7/1995 | Hannerstig | 16/87.2 |
| 6,499,708 | B1 | * | 12/2002 | Cowen | 248/261 |
| 6,698,061 | B2 | * | 3/2004 | Ho | 16/87.2 |

FOREIGN PATENT DOCUMENTS

| | | | | |
|---|---|---|---|---|
| DE | 29608769 U1 | * | 5/1997 | A47H/5/02 |
| DE | 20304065 U1 | * | 6/2003 | A47H/19/00 |
| FR | 2689382 A1 | * | 10/1993 | A47H/13/00 |
| JP | 11137416 A | * | 5/1999 | A47H/15/02 |

* cited by examiner

*Primary Examiner*—Chuck Y. Mah

(57) ABSTRACT

A hanging ring used in a curtain by punching from a metal sheet comprises: a ring body containing a ring piece having a round hole, an extending piece one end of which extends from the ring piece and an extending bar extending from another end of the extending piece. One end of the extending bar is pressed as a rivet end for being fixed in a clip. A lateral extending frame is punched from lateral sides of the enhancing edge and the extending piece. The lateral extending frame has a non-plane locking ring. A locking hole is punched from the plane locking ring. The non plane locking ring is twisted through an angle so that it is at different orientation from the other part of the lateral extending frame. An inner wall of the locking hole is a threaded wall for locking a screw rod of a decoration.

2 Claims, 5 Drawing Sheets

(A)

(B)

HANGING RING USED IN CURTAIN

FIELD OF THE INVENTION

The present invention relates to hanging rings, and particularly to hanging ring used in a curtain.

BACKGROUND OF THE INVENTION

The rod fixed curtain uses rings to engage with a rod for fixing the curtain and each ring is connected with a clip for further connecting the cloth of the curtain. Thereby, the curtain is skidable along the rod to be opened or closed. Referring to FIG. 1, a conventional process to make a ring for connecting a curtain with a rod is illustrated. In step 1*a*, a metal soldering wire 1 is cut into a desired length. In step 1*b*, the wire is bent as a solid ring 10. Thin step in 1*c*, a undesired portion H1 in the soldering portion H is polished. In (A), a hanging rod 3 is compressed into the solid ring 10. Finally, one end of the hanging rod 3 is inserted into a clip 4 and the end is pressed as a rivet end 230. Thereby, the solid ring 10, hanging rod 3 and the clip 4 are formed as an integral structure.

However, above mentioned prior art has the following disadvantages. There are several processes being performed in the manufacturing procedure. The succeeding step can be not performed continuously. Thereby, the process is tedious and inconvenient. The solid ring 10 is heavy. In use, a curtain needs many solid rings so that the opening and closing of the curtain need larger force. Moreover, the soldering process will make the connection easy to break and thus the tolerance of the structure is not good. The connection of the hanging rod to the ring has a weak structure and the hanging rod is not firmly fixed to the ring. One end of the hanging rod is inserted into the hole of the ring, thereby, interfering the operation of the curtain cloth, even the curtain cloth will be deadly buckled in the rings. The clip can not be used to couple with a rope so that the prior art is only suitable for a no-rope curtain. The ring will expose out as it is connected with the curtain cloth so that the appearance is not good.

SUMMARY OF THE INVENTION

Accordingly, the primary object of the present invention is to provide a hanging ring used in a curtain by punching from a metal sheet; the hanging comprising: a ring body containing a ring piece having a round hole, an extending piece one end of which extends from the ring piece and an extending bar extending from another end of the extending piece. One end of the extending bar is pressed as a rivet end for being fixed in a clip. A lateral extending frame is punched from lateral sides of the enhancing edge and the extending piece. The lateral extending frame has a non-plane locking ring; locking hole is punched from the plane locking ring; the non plane locking ring is twisted through an angle so that it is at different orientation from the other part of the lateral extending frame. An inner wall of the locking hole is a threaded wall for locking a screw rod of a decoration.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
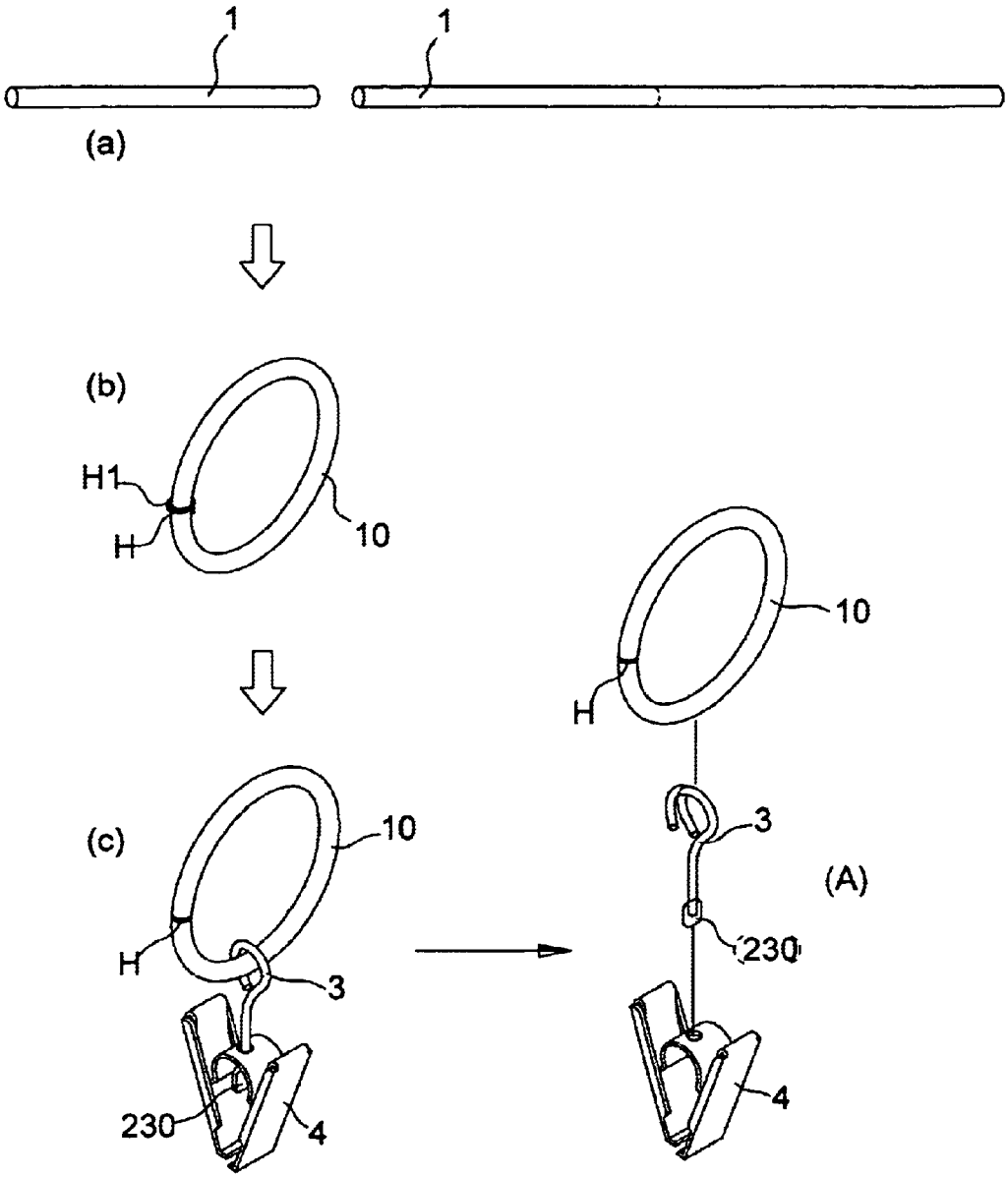
FIG.1 (Prior Art)
FIG. 1 shows the conventional shaping process.
Figure 2:
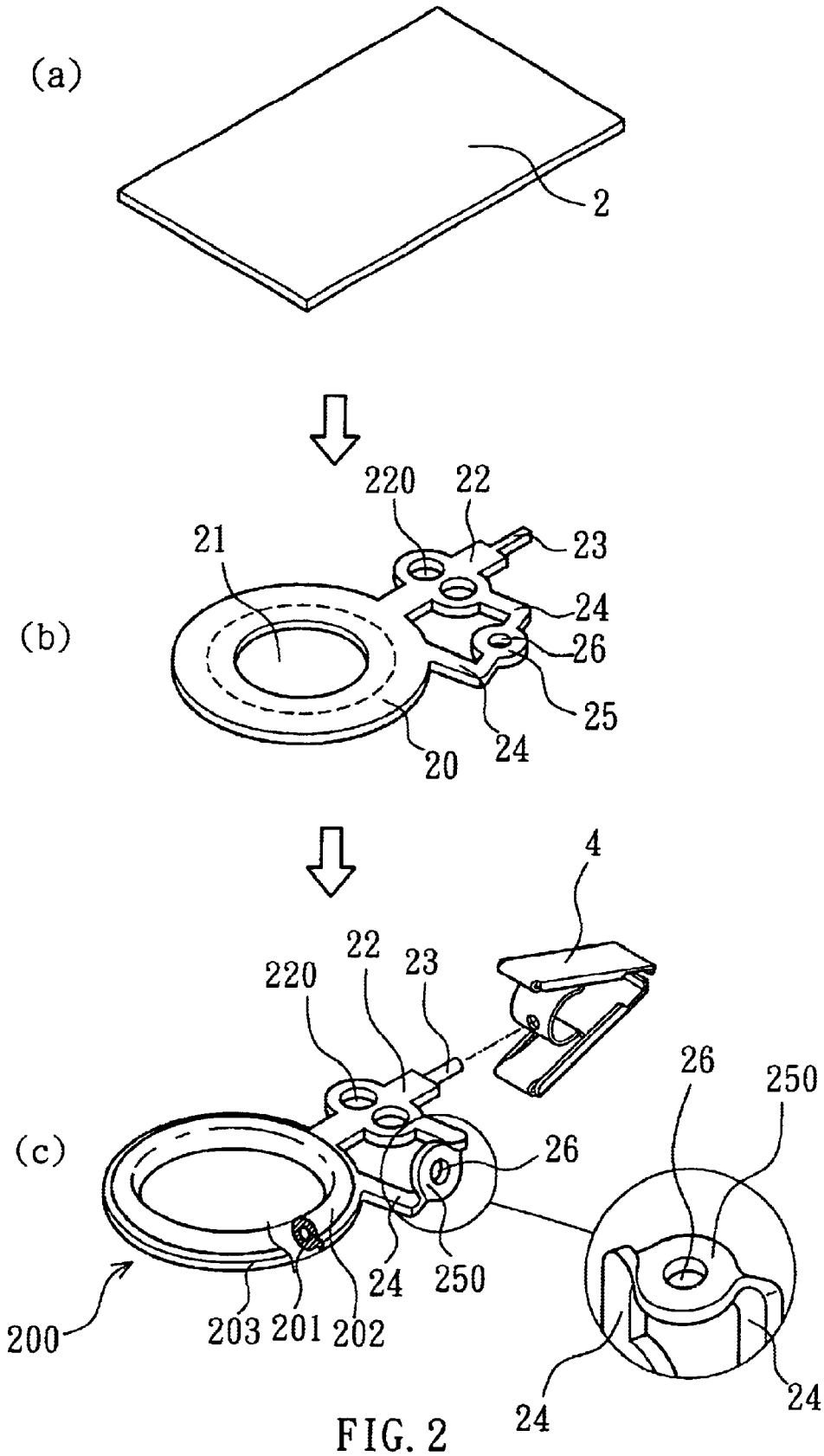
FIG. 2 shows the shaping process of the present invention.
Figure 3:
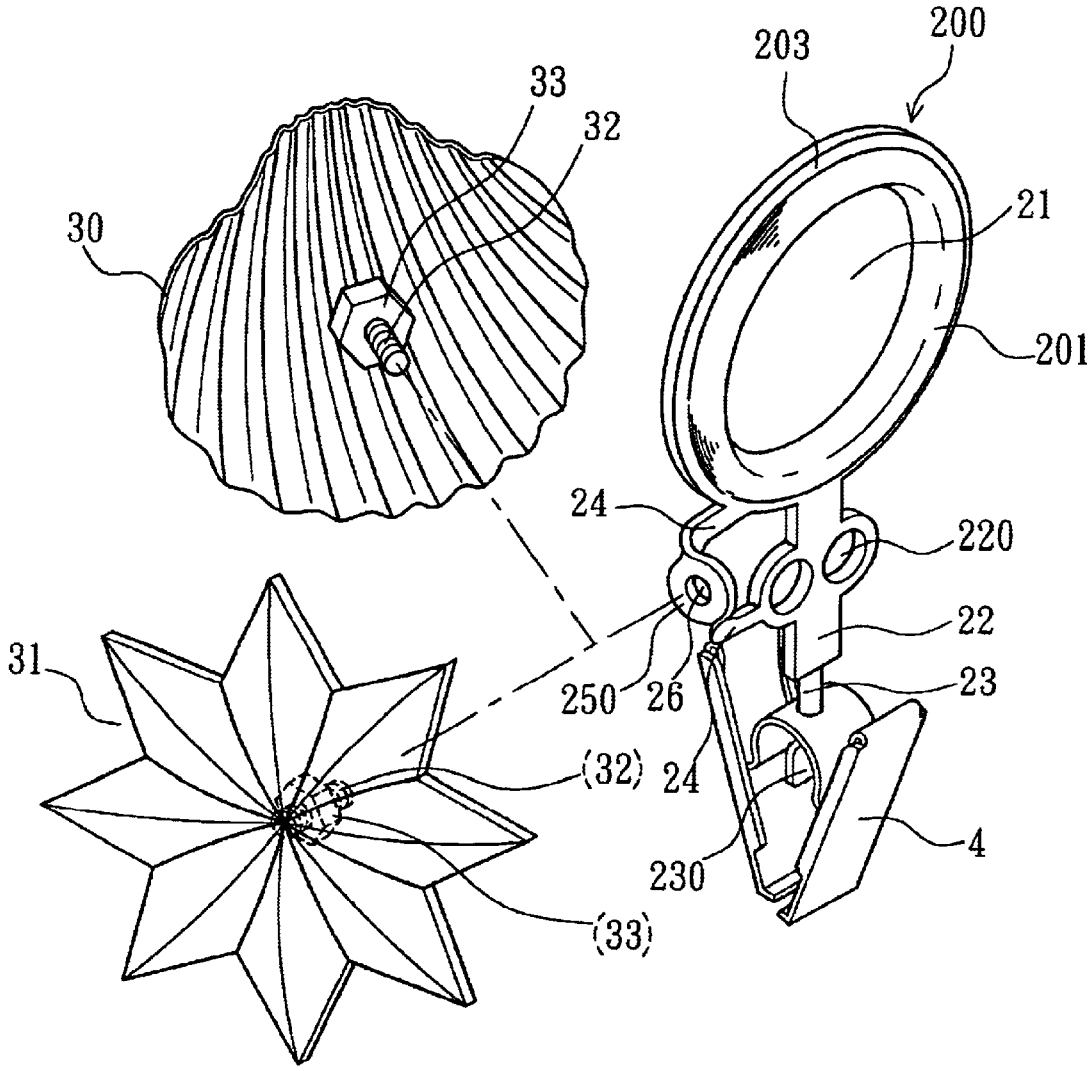
FIG. 3 is schematic perspective view of the clip and decorations of the present invention.
Figure 4:
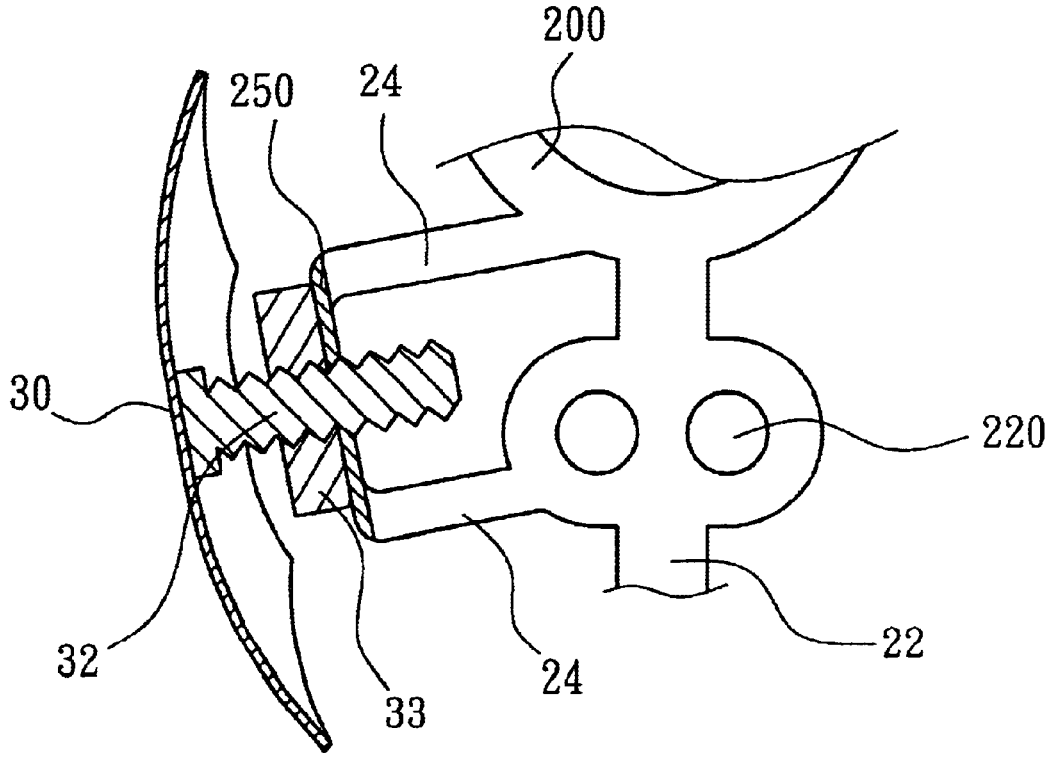
FIG. 4 shows the lateral view (a) and elevation view (b) of the present invention.
Figure 4:
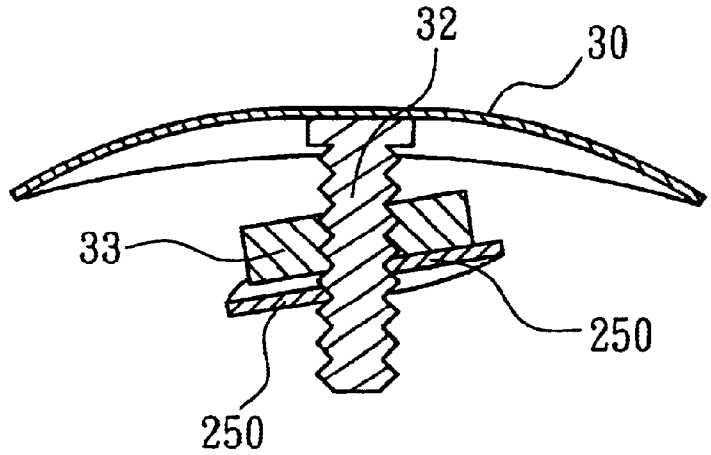

With reference to FIGS. 2, 3, and 4, at first, the metal sheet 2 is punched into a ring body containing a ring piece 20 having a round hole 21, an extending piece 22 one end of which extends from the ring piece 20, and an extending bar 23 extending from another end of the extending piece 22. Two annular sides of the ring piece 20 is formed with a front side concave cambered surface 201 and a back side concave cambered surface 202. A outer lateral side of the front side concave cambered surface 201 is chamfered as a plan inclined surface and a outer lateral side of the back side concave cambered surface 202 is also chamfered surface as a plane inclined surface. The two inclined surface of the front side concave cambered surface 201 and back side concave cambered surface 202 are formed with an enhancing edge 203 so as to enhance the strength and tolerance of the ring body 200.

The extending bar 23 can be inserted into a clip 4. An end of the extending bar 23 is pressed as a rivet end 230 for being fixed in the clip 4.

A lateral extending frame 24 is punched from the enhancing edge 203 and the extending piece 22. The lateral extending frame 24 has a plane locking ring 25 thereon. A locking hole 26 is punched from the plane locking ring 25. The plane locking ring 25 is twisted through an angle so that it is at different orientation from the other part of the lateral extending frame 24 to be as a non-plane locking ring 250. The inner wall of the locking hole 26 can be a non-plane wall, for example, threaded wall, so as to lock the screw rod 43 of the decorations 30, 31 to match the nut 33 of the screw rod 32 so that the decoration is locked to the non-plane locking ring 250.

The effects and advantages of the present invention will be described herein. In the present invention, referring to FIG. 2*a*, the metal sheet 2 is firstly placed in a mold. The metal sheet 2 is punched to have the round hole 21, ring piece 20, extending piece 22, extending bar 23, lateral extending frame 24, and plane locking ring 25 with the locking hole 26. The metal sheet 2 is further punched to form the front side concave cambered surface 201 and the back side concave cambered surface 202 so as to form the ring body 200. Then the mold is punched to form the lateral extending frame 24 and the plane locking ring 25. The plane locking ring 25 is twisted to form the non-plane locking ring 250. Then the extending bar 23 is riveted wit the clip 4.

The present invention has the advantage of preferred strength, non-deformation, non-breakage. In the present invention, the ring body is integrally formed without using any soldering process. Thereby, the disadvantage of bad-soldering and weakness will not occur. The enhancing edge 203 formed on the whole lateral side of the ring body has the effect of enhancing the structure. Thereby, the tolerance of the present invention is high and the shape of the present invention can be retained.

Moreover, in the present invention, the extending piece 22, lateral extending frame 24 and the non-plane locking ring 250 are also integrally formed. Thereby, they have a preferred structure, while the conventional extending piece 22 can not suffer from a large pulling force, otherwise it will separate from the solid ring 10. Thereby, the present invention has a preferred tolerance and large strength.

The present invention has a good appearance and practical. The ring body 200 of the present invention is hollowed. Thereby, when the curtain is desired to be opened or closed, it can be operated easily since one curtain needs a plurality of ring. The solid body is heavy. Moreover, the extending piece 22 is extended from a periphery of the ring body instead of inserted into the ring hole of the ring body as the prior art. Thereby, the hole of the ring body 200 of the present invention is a pure hole without being inserted by the extending piece 22 so that in operation, it will not be hindered by the end of the extending piece 22.

In the present invention, the non-plane locking ring 250 has the following advantages. Referring to FIGS. 3 and 4, in the present invention, the integrally formed lateral extending frame 24, non-plane locking ring 250 and the locking hole 26 are formed as a nut base for screwing the nut 33 of screw rod 32 of the decorations 30, 31 so as to have the effect of locking an object.

Figure 5:
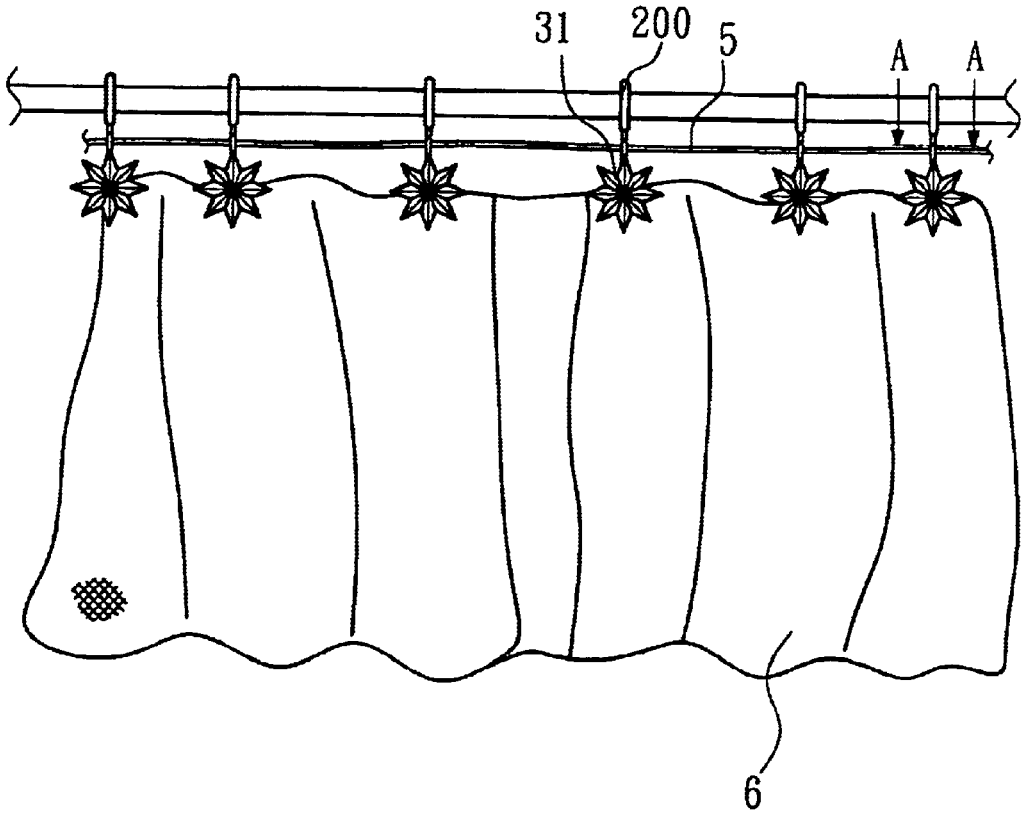
FIG. 5 shows the use of the present invention.
Figure 5:
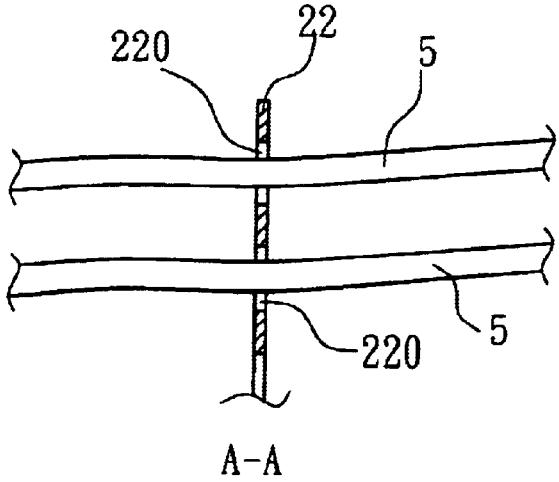

The through hole 220 of the extending piece 22 has the following effect. With reference to FIG. 5, the through hole 220 of the extending piece 22 can be assembled with a rope 5 so that the rope 5 will not suspend downwards. Thereby, the present invention can be used to a rope form curtain.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hanging ring used in a curtain, said hanging ring being formed by punching from a planar metal sheet; the hanging ring comprising: a ring body containing a ring piece having a round hole and an enhancing outer edge, an extending piece one end of which extends from said enhancing outer edge of the ring piece and an extending bar extending from another end of the extending piece; wherein one end of the extending bar is deformable as a rivet end for being fixed in a clip; a lateral extending frame is extended laterally from said enhancing edge and laterally from the extending piece; the lateral extending frame has a locking ring; a locking hole is formed in the locking ring; the locking ring is twisted through an angle so that said locking ring is non-planar with the remaining part of the lateral extending frame; and an inner wall of the locking hole is a threaded wall, for locking a screw rod of a decoration.

2. The hanging ring used in a curtain as claimed in claim 1, wherein the extending piece has at least one through hole for receiving a rope.

* * * * *